US010137337B2

(12) United States Patent
Yoshida et al.

(10) Patent No.: US 10,137,337 B2
(45) Date of Patent: Nov. 27, 2018

(54) GOLF CLUB HEAD

(71) Applicant: BRIDGESTONE SPORTS CO., LTD., Tokyo (JP)

(72) Inventors: Shintaro Yoshida, Tokyo (JP); Hiromitsu Akiyama, Tokyo (JP); Hiroshi Takahashi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 15/810,684

(22) Filed: Nov. 13, 2017

(65) Prior Publication Data

US 2018/0161645 A1 Jun. 14, 2018

(30) Foreign Application Priority Data

Dec. 9, 2016 (JP) ..... 2016-239238

(51) Int. Cl.
*A63B 53/04* (2015.01)

(52) U.S. Cl.
CPC ..... *A63B 53/0466* (2013.01); *A63B 53/04* (2013.01); *A63B 2053/0408* (2013.01); *A63B 2053/0433* (2013.01)

(58) Field of Classification Search
CPC ..... A63B 2053/0433; A63B 53/0466; A63B 53/04
See application file for complete search history.

(56) References Cited

U.S. PATENT DOCUMENTS

| | | | | |
|---|---|---|---|---|
| 6,348,013 | B1 * | 2/2002 | Kosmatka | A63B 53/04 473/329 |
| 2007/0142124 | A1 | 6/2007 | Ban | |
| 2012/0149494 | A1 * | 6/2012 | Takahashi | A63B 53/0466 473/345 |
| 2013/0065705 | A1 * | 3/2013 | Morales | A63B 53/04 473/345 |
| 2015/0045144 | A1 * | 2/2015 | Abe | B21D 53/00 473/330 |
| 2015/0265887 | A1 * | 9/2015 | Yamasawa | A63B 53/0466 473/342 |

FOREIGN PATENT DOCUMENTS

| | | |
|---|---|---|
| JP | 2001-129131 | 5/2001 |
| JP | 2003-265656 | 9/2003 |
| JP | 2007-159984 | 6/2007 |
| JP | 2015-033464 | 2/2015 |
| JP | 2015-181676 | 10/2015 |

* cited by examiner

*Primary Examiner* — John E Simms, Jr.
(74) *Attorney, Agent, or Firm* — IPUSA, PLLC

(57) ABSTRACT

A golf club head includes a head body and a face member. The head body includes a body face, a sole, and a crown. The face member is joined to an opening formed in the body face. A depression is provided between the opening and the sole in the head body.

6 Claims, 3 Drawing Sheets

GOLF CLUB HEAD

CROSS-REFERENCE TO RELATED APPLICATION

This application is based upon and claims priority to Japanese Patent Application No. 2016-239238, filed on Dec. 9, 2016, the entire contents of which are incorporated herein by reference.

BACKGROUND OF THE INVENTION

1. Field of the Invention

The present invention generally relates to golf club heads.

2. Description of the Related Art

With respect to golf club heads, various techniques have been studied to improve ball striking performance. Such techniques for improving ball striking performance include, for example, those described in Japanese Laid-open Patent Publication Nos. 2015-181676, 2015-033464, 2007-159984, 2003-265656, and 2001-129131 and U.S. Pat. No. 6,348,013. It is desired to give sufficient consideration to the face-side flexibility to improve ball striking performance.

SUMMARY OF THE INVENTION

According to an aspect of the present invention, a golf club head includes a head body and a face member. The head body includes a body face, a sole, and a crown. The face member is joined to an opening formed in the body face. A depression is provided between the opening and the sole in the head body.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE PREFERRED EMBODIMENTS

Figure 1:
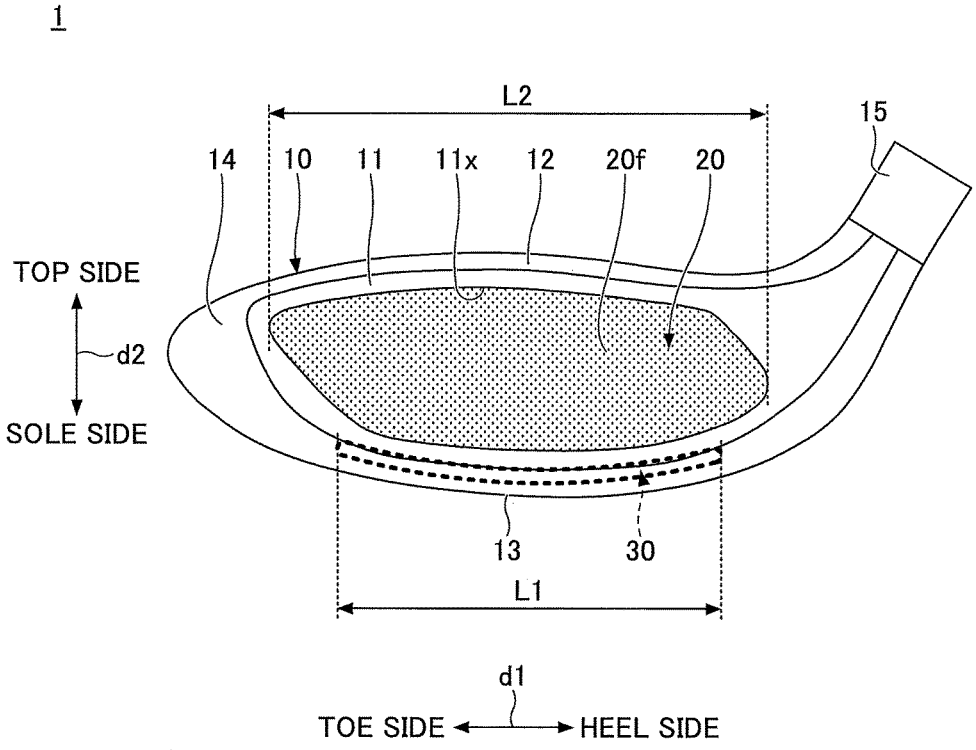
FIG. 1 is a front view of a golf club head according to an embodiment.

One or more embodiments are described below with reference to the accompanying drawings. In the following description, the same elements are referred to using the same reference numeral, and duplicate description thereof may be omitted.

Figure 2:
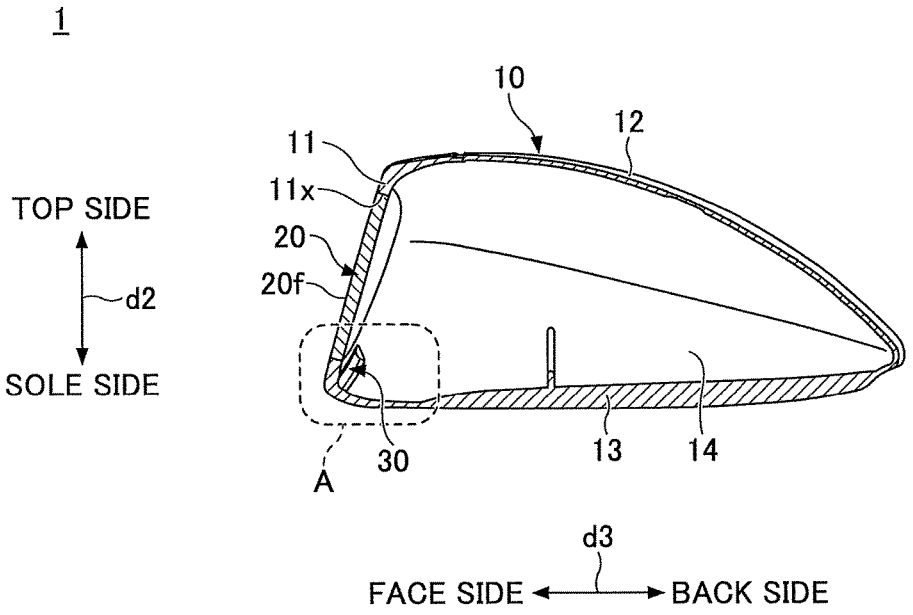
FIG. 2 is a cross-sectional view of the golf club head according to the embodiment.

FIG. 1 is a front view of a golf club head 1 according to an embodiment. FIG. 2 is a cross-sectional view of the golf club head 1, depicting a vertical cross section along a face-back direction, passing through the substantial center of a face member 20 (face) of the golf club head 1.

According to FIGS. 1 and 2, the front view is a view taken from a face surface 20*f* side, and the case where the golf club head 1 rests on a horizontal plane (corresponding to a ground surface) at a reference lie angle and a reference loft angle is illustrated. (The same applies to FIG. 3.) Furthermore, the double-headed arrow d1 indicates the "toe-heel" (left-right) direction, namely, the direction from the toe or the toe side to the heel or the heel side or the direction from the heel or the heel side to the toe or the toe side, of the golf club head 1, the double-headed arrow d2 indicates the "top-sole" (top-bottom) direction, namely, the direction from the top or the top side to the sole or the sole side or the direction from the sole or the sole side to the top or the top side, of the golf club head 1, and the double-headed arrow d3 indicates the "face-back" (front-rear) direction, namely, the direction from the face or the face side to the back (rear) or the back side or the direction from the back or the back side to the face or the face side, of the golf club head 1.

The golf club head 1 depicted in FIGS. 1 and 2 is a wood-type golf club head such as a fairway wood club head, but may also be a driver club head or a hybrid club head. Furthermore, multiple parts may be joined and assembled into the golf club head 1. The golf club head 1 is described in more detail below.

The golf club head 1 is a hollow structure that includes a head body 10 and the face member 20 joined to the head body 10. In FIG. 1, the face member 20 is indicated by a dot pattern for convenience. In the following description, a surface corresponding to an inside surface of the hollow structure may be referred to as an inside surface, and a surface corresponding to an outside surface of the hollow structure may be referred to as an outside surface. Furthermore, the inside or internal space of the hollow structure may be referred to as "hollow."

The head body 10 includes a body face 11, a crown 12, a sole 13, a sidewall 14, and a hosel 15. The head body 10 may be made using a metal material such as a titanium alloy, titanium, stainless steel, or an aluminum alloy.

A face opening 11*x* is famed in the body face 11. The face member 20 is joined to the face opening 11*x* by, for example, welding. The face member 20 defines a front portion of the golf club head 1, and includes the face surface 20*f*, which defines a ball-striking surface between the crown 12 and the sole 13 in the top-sole direction. The face member 20 has a predetermined thickness. The face surface 20*f* defines the outside surface of the face member 20. The face member 20 may be made using a metal material such as a titanium alloy, titanium, stainless steel, or an aluminum alloy.

The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 20*f*. The hosel 15 receives a shaft.

The inside surface of the body face 11 is depressed at the lower end of the body face 11 to form a depression 30 on the sole 13 side of the face opening 11*x* in the head body 10. A length L1 of the depression 30 in the toe-heel direction is smaller than a length L2 of the face member 20 in the toe-heel direction. This makes it possible to increase the sole-side flexibility of the face member 20 and the body face 11. The length L1 of the depression 30 may be, for example, 30 mm or more and 70 mm or less (30 mm≤L1≤70 mm). The length L2 of the face member 20 may be, for example, 50 mm or more and 90 mm or less (50 mm≤L2≤90 mm).

Figure 3:
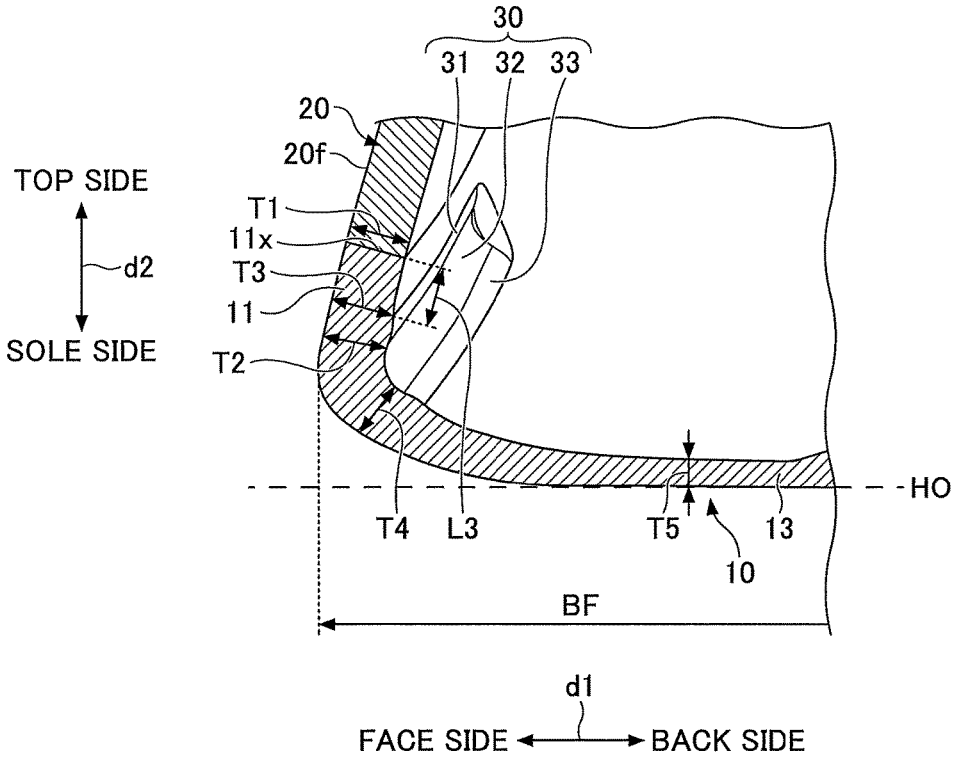
FIG. 3 is an enlarged view of part A of FIG. 2.

The depression 30 is described in more detail below. FIG. 3 is an enlarged view of part A of FIG. 2. In FIG. 3, HO indicates a horizontal plane (corresponding to a ground surface). Furthermore, in FIG. 3, a region of the outside surface of the golf club head 1 on the sole 13 side (except the hosel 15) which region is projected onto the horizontal plane HO, namely, a region of the outside surface of the golf club head 1 which region faces a plane BF, is defined as the bottom surface of the head body 10. Here, the bottom surface extends from the boundary between the body face 11 and the sole 13 to cover the sole 13.

Referring to FIG. 3, the depression 30 includes an upper curved surface 31 elongated along the length of the depression 30 and protruding inward (toward the hollow), a middle curved surface 32 elongated along the length of the depression 30 and protruding outward (toward the outside of the head body 10 or the golf club head 1), and a lower curved surface 33 elongated along the length of the depression 30 and protruding inward. The lower curved surface 33 is positioned across the middle curved surface 32 from the upper curved surface 31 to be closer to the sole 13 than is the upper curved surface 31. A minimum distance between the face opening 11*x* and the depression 30, L3, may be, for example, 1 mm or more and 10 mm or less (1 mm≤L3≤10 mm).

Letting the thickness of the face member 20 at its lower end be T1, letting the minimum thickness of a portion of the body face 11 between the depression 30 and the outside surface of the body face 11 be T2, and the maximum thickness of a portion of the body face 11 between the face member 20 and the depression 30, be T3, T1<T3 and T2<T3 hold. This makes it possible to increase the flexibility of the face of the golf club head 1 while improving the durability of the body face 11 at its lower end.

Furthermore, causing T1 and T2 to be substantially equal makes it possible to strike a better balance between the durability of the body face 11 at its lower end and the flexibility of the face. There may be manufacturing error between the values of T1 and T2 that are substantially equal.

Furthermore, the minimum thickness of a portion of the sole 13 between the depression 30 and the bottom surface of the head body 10, T4, is greater than the minimum thickness of the (entire) sole 13, T5. This makes it possible to increase the face-side durability of the golf club head 1.

Thus, according to the golf club head 1, the depression 30 is provided between the face opening 11*x* and the sole 13 in the head body 10. This makes it possible to increase the flexibility of the face to improve the ball striking performance.

Specifically, in the case of welding the head body 10 and the face member 20, the thickness of the head body 10 may increase near the face opening 11*x* to decrease the flexibility of the face. By providing the depression 30 at a position closer to the sole 13 than is the face opening 11*x* in the head body 10, however, it is possible to cause the face to sufficiently flex on the sole 13 side even when striking a golf ball on the sole 13 side of the face.

Thus, according to an aspect of the present invention, a golf club head with improved flexibility on the face side is provided.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, the hosel 15 may be configured to allow a sleeve fixed to the end of a shaft to be removably attached to the hosel 15. Use of the sleeve facilitates replacement of the shaft. Furthermore, the axis of a shaft insertion hole provided in the sleeve may be inclined relative to the central axis of the bore of the hosel 15. In this case, it is possible to change the lie angle or face angle by rotating the sleeve about its axis to change a position at which the sleeve fits to the hosel 15.

What is claimed is:

1. A golf club head, comprising:
a head body including
a body face;
a sole; and
a crown; and
a face member joined to an opening formed in the body face,
wherein a depression is provided between the opening and the sole in the head body, wherein a minimum thickness of a portion of the sole between the depression and a bottom surface of the head body is greater than a minimum thickness of an entirety of the sole.

2. The golf club head as claimed in claim 1, wherein the depression is provided in an inside surface of the body face at a lower end thereof.

3. A golf club head, comprising:
a head body including
a body face;
a sole; and
a crown; and
a face member joined to an opening formed in the body face,
wherein a depression is provided between the opening and the sole in the head body, wherein T1<T3 and T2<T3 hold, where T1 is a thickness of the face member at a lower end thereof, T2 is a minimum thickness of a portion of the body face between the depression and an outside surface of the body face, and T3 is a maximum thickness of a portion of the body face between the face member and the depression, and
wherein T1 and T2 are substantially equal.

4. The golf club head as claimed in claim 1, wherein a length of the depression in a toe-heel direction from a toe to a heel of the golf club head is smaller than a length of the face member in the toe-heel direction.

5. The golf club head as claimed in claim 1, wherein a minimum distance between the opening and the depression is 1 mm or more and 10 mm or less.

6. The golf club head as claimed in claim 1, wherein the depression includes
an upper curved surface protruding toward a hollow of the golf club head;
a lower curved surface protruding toward the hollow; and
a middle curved surface protruding toward an outside of the golf club head between the upper curved surface and the lower curved surface.

* * * * *